US010529166B2

(12) United States Patent
Bouthiette

(10) Patent No.: US 10,529,166 B2
(45) Date of Patent: Jan. 7, 2020

(54) PILL MANIPULATING SYSTEM, PILL MANIPULATOR AND METHOD FOR FILLING A PACKAGING WITH PILLS

(71) Applicant: 9155-0020 Québec Inc., Granby (CA)

(72) Inventor: Etienne Bouthiette, Montreal (CA)

(73) Assignee: 9155-0020 Quebec Inc., Granby (CA)

( * ) Notice: Subject to any disclaimer, the term of this patent is extended or adjusted under 35 U.S.C. 154(b) by 339 days.

(21) Appl. No.: 15/446,330

(22) Filed: Mar. 1, 2017

(65) Prior Publication Data

US 2018/0253926 A1 Sep. 6, 2018

(51) Int. Cl.
*G07F 11/16* (2006.01)

(52) U.S. Cl.
CPC ..... *G07F 11/165* (2013.01)

(58) Field of Classification Search
CPC ..... G07F 11/165
USPC ..... 700/231–244; 221/211
See application file for complete search history.

(56) References Cited

U.S. PATENT DOCUMENTS 4,026,091 A 5/1977 Pearson
5,405,048 A * 4/1995 Rogers ..... B65G 1/1373 221/1
5,571,258 A * 11/1996 Pearson ..... A61J 7/0084 221/211
5,788,079 A 8/1998 Bouthiette
6,607,094 B2 * 8/2003 MacDonald ..... A61J 7/0084 221/121
6,925,783 B1 * 8/2005 Pearson ..... B65B 5/08 53/243
7,472,526 B2 * 1/2009 Pearson ..... B65B 5/08 53/243
7,726,514 B2 * 6/2010 Janet ..... A61J 7/02 221/13
8,230,662 B2 7/2012 Boutin
2015/0128534 A1 5/2015 Bouthiette et al.
2016/0083120 A1 3/2016 Bouthiette
2017/0021950 A1 1/2017 Bouthiette

FOREIGN PATENT DOCUMENTS

CA 2843074 A1 2/2015
WO 9617776 A1 6/1996

* cited by examiner

*Primary Examiner* — Michael Collins
(74) *Attorney, Agent, or Firm* — Occhiuti & Rohlicek LLP

(57) ABSTRACT

A pill manipulating system for filling a packaging with pills is provided, as well as a corresponding method. The system comprises a vacuum pump, a pill manipulator including a hose connected to the vacuum pump, and at least one prong. The prong(s) has/have an opening at one end sized to retain a pill when the pill manipulator is in a retain configuration and suction is applied, and to release the pill when the pill manipulator is in a release configuration and suction is reduced. The system includes a vacuum pump controlling assembly including a variable frequency drive, for adjusting an air flow of the vacuum pump based on a selected input, which is representative of a size of the pills being manipulated, thereby reducing the likelihood of having the at least one prong retaining more than one pill at a time.

16 Claims, 7 Drawing Sheets

PILL MANIPULATING SYSTEM, PILL MANIPULATOR AND METHOD FOR FILLING A PACKAGING WITH PILLS

FIELD OF THE INVENTION

The present invention relates to systems and methods for filling pill packaging. More particularly, the present invention relates to a pill manipulating system, a pill manipulator and a method for filling a packaging having a plurality of cavities, with pills.

BACKGROUND OF THE INVENTION

In the field of packaging for small consumer goods, there exist different ways to fill such packaging intended to protect the goods during transport, distribution, and sale to the consumer. One example of such packaging is the blister pack, also called blister band or blister card, which are terms used for various types of pre-formed plastic packaging.

In the pharmaceutical field, which is one example of a field in which blister packs are commonly used, the pockets of the blister packs are normally filled with pills. The pockets are then sealed so that the pills are protected from the elements and secured within.

Often, a professional such as a pharmacist or lab technician, will manually fill each pocket of the blister pack with a corresponding pill or with many different pills for a same dosage period. It can be appreciated that one disadvantage associated with this method is that it is time consuming to individually fill each pocket of a blister pack, especially when filling out a prescription of medication for a long duration. It may further disadvantageously lead to human error if an incorrect tablet is placed in a corresponding pocket.

Other techniques for filling a blister pack are currently available. One example includes the system produced by Synergie Médicale BRG inc., commercialized under the trade-mark SynMed and described in U.S. Pat. No. 8,230,662.

Some drawbacks associated with such automated systems include: a) they can be too costly to install or operate; b) they occupy valuable space within a pharmacy; c) they often require complicated migration and installation of information technology to manage and control operations; d) each pill in the machine's inventory needs to be in its specific container for its particular size to avoid having several pills retained by each prong; and e) they can be relatively complicated and time consuming to operate and maintain.

The Applicant has developed a vacuum filling assembly for filling the cavities of packaging with objects, as described in CA 2,843,074. The filling assembly has a handle which can be gripped by a user so as to manually operate the filling assembly. The filling assembly also has a manifold capable of generating suction, such as from a vacuum supply. A valve is used to control the suction applied to objects, and is operable between a retain and release configuration. The filling assembly also has a plurality of prongs which are in fluid engagement with the manifold so that the objects are retained at the end of the prongs when the valve is in the retain configuration, and can be released into the cavities of the packaging when the valve is in the release configuration. The size of the prongs can be adapted to the various sizes of the objects to be manipulated.

However, when the above-described vacuum filling assembly is used to manipulate small pills, it is possible for several pills to be retained by each prong, which is undesirable since typically only one pill at a time must be placed in a corresponding blister pack pocket. It then becomes difficult for the user to transfer single pills associated with each prong to a corresponding pocket of a blister pack. Moreover, control of the valve connected vacuum supply is also difficult to adjust.

Hence, in light of the foregoing, there is a need for a device which, by virtue of its design and components, would be able to overcome or at least minimize some of the aforementioned prior art drawbacks.

SUMMARY OF THE INVENTION

According to an aspect of the invention, a pill manipulating system for filling a packaging having a plurality of cavities with pills is provided. The system comprises a vacuum pump, a pill manipulator and a vacuum pump controlling assembly. The pill manipulator includes a hose in fluid engagement with the vacuum pump, and at least one prong in fluid engagement with the hose. The at least one prong has an opening at one end sized to retain a pill when the pill manipulator is in a retain configuration and suction is applied, and to release the pill in a corresponding cavity of the packaging when the pill manipulator is in a release configuration and suction is reduced. The vacuum pump controlling assembly preferably includes a variable frequency drive, for adjusting an air flow of the vacuum pump based on a selected input. The input is representative of a size of the pill(s) being manipulated, which can reduce the likelihood of suctioning more than one pill at the tip of the prong(s). The variable frequency drive can be a single or a three-phase variable frequency drive.

According to possible embodiments a pill manipulating system, the input is a graphical user interface for selecting a pill type to be manipulated. The input may allow the selection of a national drug code (NDC) or a drug identification number (DIN).

The vacuum pump typically comprises a motor, and the controlling assembly varies the rotational speed of the motor based on the input selected. The vacuum pump controlling is assembly can vary at least one of current, voltage and frequency supplied to the vacuum pump based on the input selected.

According to possible embodiments, the pill manipulator system may include a first actuator operatively connected to the vacuum pump, for actuating a main valve of the vacuum pump and placing the manipulator in the release configuration. The pill manipulator system may also include a second actuator for actuating a valve in fluid communication with a vent provided along a suction flow path extending from the vacuum pump to the at least one prong. The second actuator opens the vent and therefor reduces suction in the at least one prong upon being activated, so as to allow releasing extra pill(s) suctioned at the end of the at least one prong when the manipulator is in the retain configuration.

Optionally, the pill manipulating system may include a pressure relief valve disposed between the vacuum pump and the main valve.

The pill manipulating system may also optionally include a proportional valve provided along a suction flow path extending from the vacuum pump to the at least one prong, the proportional valve having an adjustable 0%-100% opening.

According to possible embodiments, the pill manipulating system may include a computer providing the input. The vacuum pump controller assembly may include a controller board operatively connected to the computer and to the vacuum pump, the controller board translating instructions received from the computer with regard to the pill size or pill type into instructions for the variable frequency drive to control the rotational speed (rpm) of the motor.

The pill manipulating system may further include at least one of a pressure and a temperature sensor. The vacuum pump controlling assembly may control operation of the vacuum pump based on readings from said at least one sensor.

In possible configurations, the pill manipulator comprises a handle extending from the hose, and a manifold provided between the handle and the at least one prong, the pill manipulator being manually operable.

According to possible embodiments, the vacuum pump controlling assembly can set a rotational speed of the vacuum pump to a first value for a first selected pill type, and it can set the rotational speed of the vacuum pump to a second value lower than the first value for a second pill type that is smaller than the first pill type.

According to possible embodiments, the pill manipulating system may include a non-transitory memory for storing rotational speeds of the vacuum pump associated with predetermined pill types.

Optionally, the input for selecting the pill type can be provided by a software module adapted to read patient prescriptions and determine the pill type from information provided in the patient prescriptions.

According to another aspect of the invention, a method for inserting pills into packaging having a plurality of cavities is provided. The method helps reducing the likelihood of suctioning more than one pill at the tip of the prong(s), by adjusting the suction level based on an input (such as DIN or NDC for example) which is indicative of the size of the pills. The method may also provide means to release extra pills, if the situation occurs. The method includes the general steps of applying suction to at least one prong of a pill manipulator, and of adjusting a level of the suction pill manipulator based on a pill type or pill size, and retain one pill on a tip of the at least one prong via the suction. Then, the tip of the at least one prong is positioning over a corresponding cavity of the packaging; and the one pill is released into the corresponding cavity, thereby filling the packaging. In the event that after having adjusted the level of the suction based on a pill type or pill size, some or all of the prong(s) suctioned more than one pill, the method may include a step of opening a vent in fluid communication with the at least one prong and a vacuum source, so as to release the extra pills.

Preferably, the step of adjusting the level of suction is accomplished by varying a rotational speed of the vacuum pump that provides suction to the at least one prong of the pill manipulator.

Preferably, the method includes a step of selecting a pill type by selecting or entering a national drug code (NDC) or drug identification number (DIN) on a user interface, but other options are possible, such as by activating a switch with levels corresponding to different rotational speeds of the motor of the vacuum pump.

According to possible configurations, the manipulating steps are performed manually by an operator, using the pill manipulator.

Preferably, releasing the pills from the prongs comprises closing a valve of the vacuum pump to place the manipulator in the release configuration. Optionally, a vent provided between the valve and the at least one prong can be opened, to reduce suction faster in the at least one prong.

Yet according to another aspect of the invention, a pill manipulator is provided. The pill manipulator is as described above and is characterized in that the hose is made of a flexible material and is provided with helicoidal grooves on its outer surface. The hose includes at least one electrical cable nested in adjacent ones of the helicoidal grooves, at least one electrical cable operatively connecting the valve and/or the suction supply. The helicoidal grooves have a radius of curvature, and one or more cables nested in the grooves have a radius corresponding to the radius of curvature of the grooves. Preferably, the hoses includes four cables and the hose has a diameter between 0.25 and 1.75 inch. Also preferably, the hose can maintain its shape when subjected to pressure of −15 to −30 psi.

DETAILED DESCRIPTION OF EMBODIMENTS OF THE INVENTION

Figure 2:
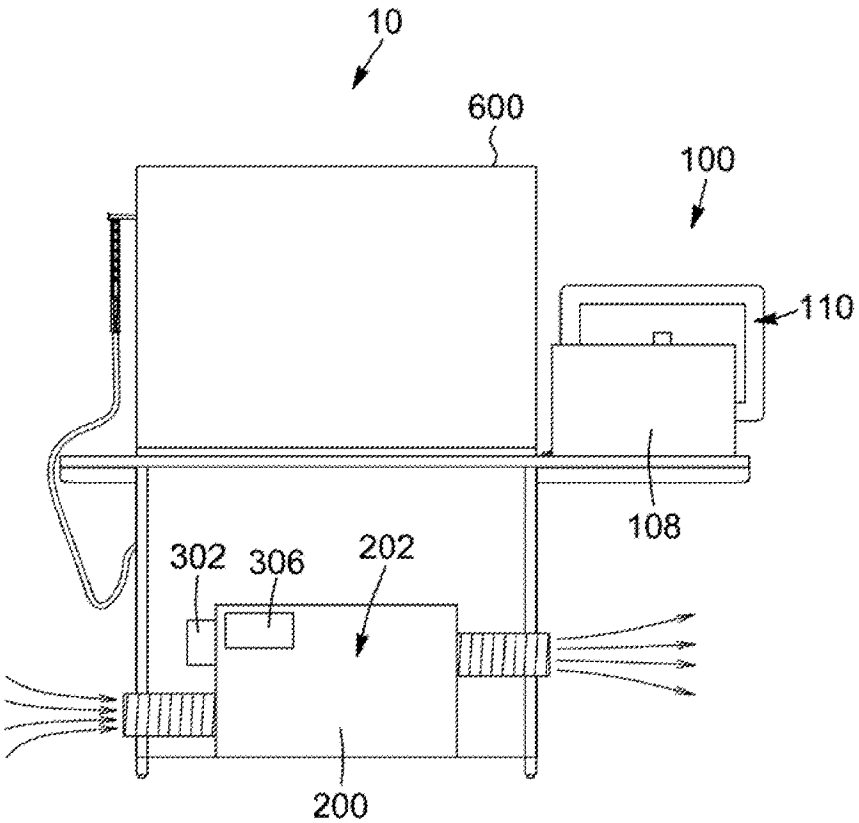
FIG. 2 is a rear view of the pill manipulating system of FIG. 1.

In the following description, the same numerical references refer to similar elements. Furthermore, for the sake of simplicity and clarity, namely so as to not unduly burden the figures with several references numbers, not all figures contain references to all the components and features, references to some components and features may be found in only one figure, and components and features of the present invention illustrated in other figures can be easily inferred therefrom The embodiments, geometrical configurations, materials mentioned and/or dimensions shown in the figures are optional, and are given for exemplification purposes only.

Furthermore, although the present invention may be used with various objects, such as pills, it is understood that it may be used with other objects, and to fill other types of packaging. For this reason, expressions such as "pill", "medicine", "tablet", "medication", "pharmacist", "prescription", "pharmacy", etc, as used herein should not be taken to limit the scope of the present invention to the filling of blister packs.

The pill manipulating system 10, also referred as "vacuum system", an example of which is shown in FIGS. 1 to 7, is a system which, in some of its configurations, enhances the ability of a person to quickly and accurately fill a packaging 20 with objects 24, typically pills. Pills may take the form of tablets, capsules, or any form of solid medication which may come in different sizes, weights and shapes. In the present description, the term "pill" is used, and is meant to encompass all types of solid drugs and medication, including capsules, tablets, pellets and the like. Broadly described, the pill manipulating system 10 of the present invention comprises a vacuum control assembly which controls the vacuum level and air flow used to pick up pills, based on an input, which preferably represents the type of pill selected.

A common drawback of existing pill manipulating systems for filling blister packs with pills, is that the vacuum pump throughput (or air flow) remains the same regardless of the type of pill to pick up, i.e. regardless of the pill size, shape or weight. The vacuum pump is typically turned on or off and works at a preset flow rate and RPM (rotations per minute). In such systems, i.e. systems in which the same flow rate is used regardless of the size of the pills, the vacuuming tool frequently picks up more than one pill at a time, especially when smaller pills are handled.

Advantageously, the pill manipulating system of the present invention allows adjusting or varying the level of suction (which translates into working or maximum air flow at the pump) according to a given input, such as the pill type that is handled, in order to reduce occurrences of the prong(s) picking up more than one pill at a time. In other words, the maximum air flow of the vacuum pump, which is directly related to the rotational speed of its motor, can be adjusted or varied based on the type of pill selected. The suction level is thus adjustable dependently of the type of pill that is being manipulated. More specifically, the controlling assembly can include a non-transitory memory for storing RPM (rotations per minutes) values needed to pick up pills one by one, according to different pill types, having different weights and/or sizes. The pill type typically corresponds to the national drug code (NDC) or the drug identification number (DIN). Adjusting (i.e. increasing or decreasing) the motor's RPM adjusts in turn the air flow of the vacuum pump. According to one possible embodiment, a user selects a pill type at an input, which is typically a graphical user interface, out of several possible pill types, and instructions are sent to the pump motor, via a controller board and a variable frequency drive (VFD), to increase or decrease the RPM according to the values registered for said specific pill type. Adjusting the rotational speed of the motor based on the pill type reduces the risk of sucking up more than one pill at a time. As it will be explained in greater detail below, controlling the vacuum pump can be achieved by different means, including using a variable frequency drive or using a customized electrical circuit, such as a sine wave inverter circuit. Other benefits of the present invention, depending on its configuration, include the possibility of decreasing or increasing the power of the vacuum pump by adjusting the current to the vacuum pump below or above the power line frequency (typically 60 Hz). Another advantage of the present invention is that it allows placing the vacuum pump in stand-by mode. The vacuum pump controller can also be used to monitor the behavior/status of the pump.

Referring to FIGS. 1 to 5, the pill manipulating system 10 includes an input 102; a vacuum pump 202 (shown in FIG. 5)—provided in this example in a vacuum supply enclosure 200; a pill manipulator 400 and a vacuum pump controlling assembly 300 (shown in FIG. 5), also provided in the vacuum supply enclosure 200.

Figure 8:
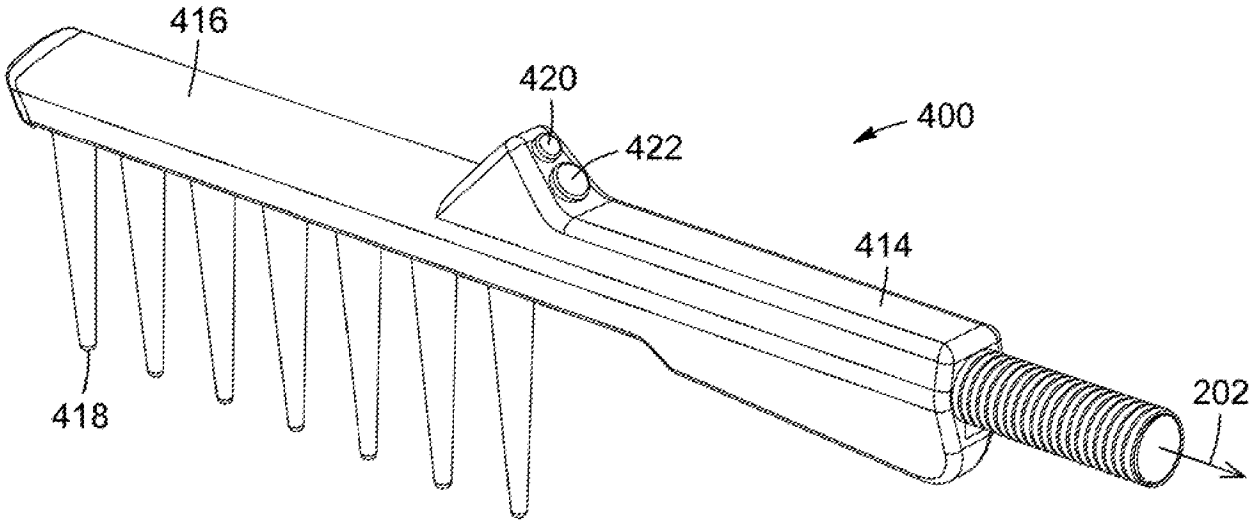
FIG. 8 is a schematic illustration of a dispenser, according to a possible embodiment.

A possible embodiment of a pill manipulator 400 is best shown in FIG. 8. The pill manipulator can be any device, tool, or mechanism whose collection of parts allows for suctioning up pills and releasing or dispensing them to fill the cavities of a packaging 20. The pill manipulator 400 comprises one or more prongs 418, each having an opening 419 at one end sized to retain a pill at the tip of the prong when the manipulating tool is in a retain configuration, and suction is applied. Each prong preferably picks up pills one by one, so as to fill the cavities with a single pill at a time. In the optional embodiment shown in FIG. 4, the packaging 20 has seven rows of cavities 22 corresponding to different days of the week, as well as four columns of cavities 22, corresponding to the four intake times of a day (e.g. morning, noon, evening, and bedtime). Other configurations and shapes for the packaging 20 are possible. Consequently, the pill manipulator can include more than one prong, and preferably a number of prongs corresponding to the number of rows in the packaging 20.

In the illustrated embodiment, the pill manipulator 400 can be manually manipulated by the hand of a user, such as a pharmacist or technician. Alternately, the filling assembly 400, its components, and/or its operation can be automated. According to another possible embodiment, the pill manipulator 400 and pill containers 608 are operated and manipulated by robotized arms, instead of human arms.

Figure 4:
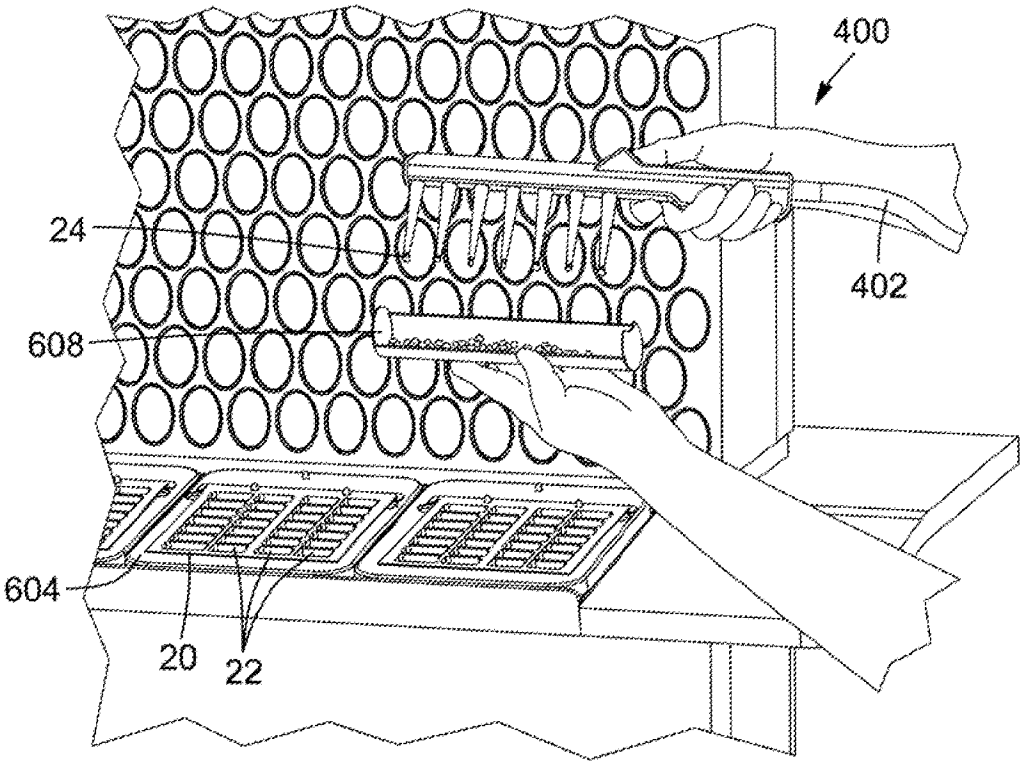
FIG. 4 is a partial view of the pill manipulating system of FIG. 1, shown during use thereof.
Figure 3:
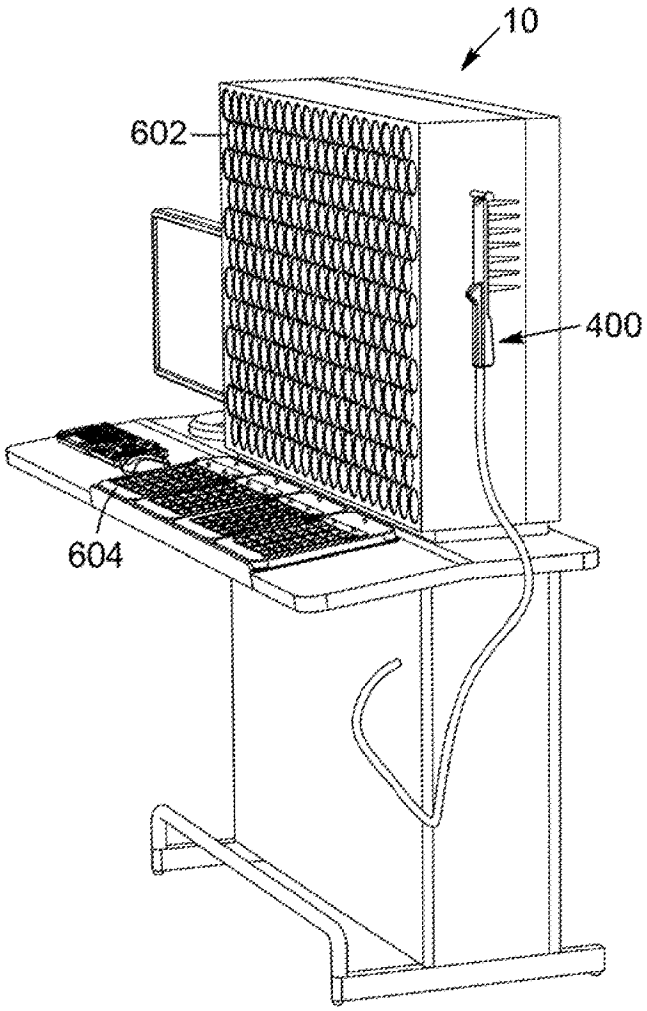
FIG. 3 is a side perspective view of the pill manipulating system of FIG. 1.

Referring to FIGS. 4 and 8, the pill manipulator 400 includes a hose 402 that receives suction from a source vacuum, i.e. typically a vacuum pump 202 including a DC or AC motor. The pill manipulator 400 is operable between a retain configuration where suction is applied and a release configuration, where suction is reduced. The vacuum pump can be activated by an on/off switch located on or near the pump, and/or from a graphical user interface.

In the illustrated embodiment, the number of prongs corresponds to the number of rows in the packaging, but other configurations are possible. In use, air is vacuumed through the prongs, and when the prongs are placed over a pill container 608 filled with pills, each prong applies suction to a corresponding pill, thereby retaining the pill. The pill manipulator 400 is thus in a retain configuration. In the release configuration, the suction level at each prong is reduced sufficiently to release the pill. According to one possible embodiment, an actuator, such as a push button, is actuated to control a main valve of the pump, to reduce suction, causing the pills to be dropped. In the embodiment illustrated, the pill manipulator 400 has a handle 414 on which the actuator is provided. The handle 414 can be any part of the pill manipulator 400 which can be easily and ergonomically held by one, or both, hands of the user of the pill manipulator 400.

Still referring to FIGS. 4 and 8, the pill manipulator 400 can have manifold 416. The manifold 416 receives the suction from a vacuum supply, which is further described below, and supplies suction or vacuum to the plurality of prongs 418, as also explained below. As such, the manifold 416 can be any chamber, pipe, conduit, etc. having one or more intakes or exits used to collect and distribute a fluid, which is air in most embodiments. It can thus be appreciated that the manifold 416 can have a different shape or configuration than the one shown in FIG. 8. Moreover, in some implementations, the pill manipulator 400 may not include a manifold at all.

The one or more prongs 418 receive suction. The term "suction" refers to the force acting upon the pills 24 due to the pressure difference between the interior of the prongs 418 and the surrounding environment. For example, in most embodiments, the vacuum supply will cause the inside of the prongs to have a lower pressure than atmosphere. This will cause air to be drawn into the aperture provided at the end of each prong 418, and through the channel provided inside the prongs, thereby producing the suction, or force, which retains the pills 24 against the prongs. The inside of the pill manipulator may thus form a closed or sealed connection with the vacuum supply so as to advantageously improve the suction applied to the pills 24. The prongs 418 can be of any suitable shape or configuration so as to accomplish their pick up/release functionality, Referring to FIGS. 8 and 9, suction is supplied to the prongs by starting the vacuum pump 202. The pill manipulator 400 includes a first actuator 420 that actuates (closes or opens) a main valve 208, disposed along the vacuum flow path, between the pump 202 and the pill manipulator 400. The main valve 208 is normally open, meaning that air can be suctioned through the prong(s) to suction pills when the first actuator is in its default position. Preferably, since the vacuum flow is adjusted based on the pill type, in most cases the prong(s) will retain a single pill at a time. However, in instances where some of the prongs retain more than one pill, it is possible to release the extra pills by actuating the second actuator 422, which will open a vent 206 disposed between the main valve and the pill manipulator 400. The vent 206 is normally closed. By actuating the second actuator 422, in this case a push button, the vent 206 opens and suction is reduced at the tip of the prong, causing the extra pills to drop, while retaining a single pill per prong. In alternate embodiments, it can be considered that the suction be reduced by vibrating or striking the prong(s) or by shaking or by a quick acceleration of the pill manipulator, causing a sudden drop of suction, and in turn causing the extra pill(s) to be released.

When there is a single pill per prong, the pills can be released in the cavities 22 of the packaging 20. This is done by placing the pill manipulator 400 in the release configuration. According to the embodiment illustrated, the pill manipulator can be placed in the release configuration by actuating the first actuator 420, in this case a push button. By pressing the actuator 420, the main valve 208, which is normally opened, closes, thus reducing suction at the tip of the prong(s). In addition to closing the main valve 208, the vent 206 can be opened to release the pills faster. Upon releasing the first actuator 420, the vent 206 closes, arid the main valve 208 opens again, reverting to its normally open state. Preferably, the vacuum supply assembly 200 includes a pressure relief valve 210 to protect the pump. The pressure relief valve is normally closed, and can be configured or set to open at a predetermined pressure, such as between −20 to −18 psi, to limit the maximum vacuum supplied by the pump. In other embodiments, it can be considered to replace the main valve 208 by a proportional valve, having an adjustable 0%-100% opening. In other embodiments, in replacement or in addition to having a control of the valve and vent placed directly on the pill manipulator 400, a control can be provided elsewhere, such as on a Graphical User Interface (GUI) of a software application, for controlling the operation of the pill manipulating system.

Figure 8B:
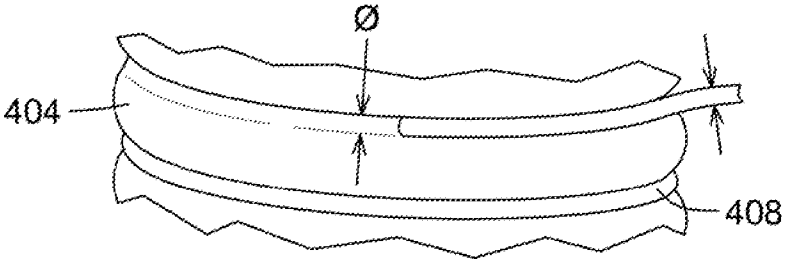
FIG. 8B is another enlarged view showing the grooves of the hose, and an electrical cable nested therein.
Figure 8A:
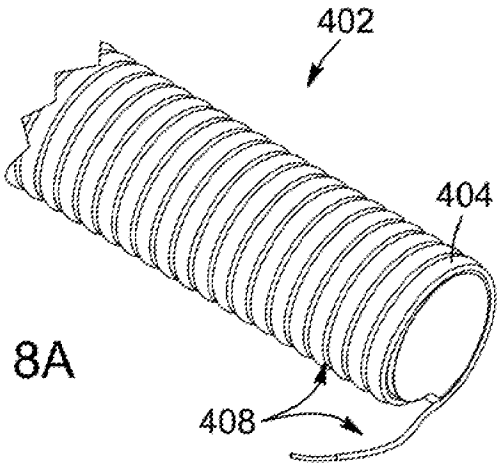
FIG. 8A is an enlarged view of a hose of the pill manipulator, according to a possible embodiment.

Referring now to FIGS. 8, 8A and 8B, the hose 402 is made of a flexible material, typically plastic, and is provided with helicoidal grooves on its outer surface. The hose further includes at least one electrical cable nested in adjacent helicoidal grooves. For example, the electrical cable can operatively connect one or more actuators 420, 422 with the vent valve and/or vacuum pump. In a preferred embodiment, the flexible hose 402 includes four electrical cables nested in corresponding hose grooves, i.e. one for the ground, one for the first actuator 420, one for the second actuator 422 and one for 5V-voltage, for illuminating the actuators (such as buttons) with LEDs. Of course, a different number of cables can be used, according to the configuration of the manipulator 400. In order for the hose to be manoeuvrable and easy to handle, the one or more electrical cables preferably have a radius corresponding to the radius of curvature of the grooves.

In some implementations, as mentioned above, the filling assembly may not include a manifold at all. In such embodiments, each prong can be connected to an individual vacuum tube or hose, each vacuum hose being connected to the vacuum supply. Different valves and actuators can then be associated with each hose. In such an assembly, the vacuum supply can be cut to individual hoses if the hoses are required for a particular filling operation. Moreover, this ensures a reduction in the weight of the components being manipulated by a user as the valve assemblies are located proximate the vacuum supply or pump.

Figure 1:
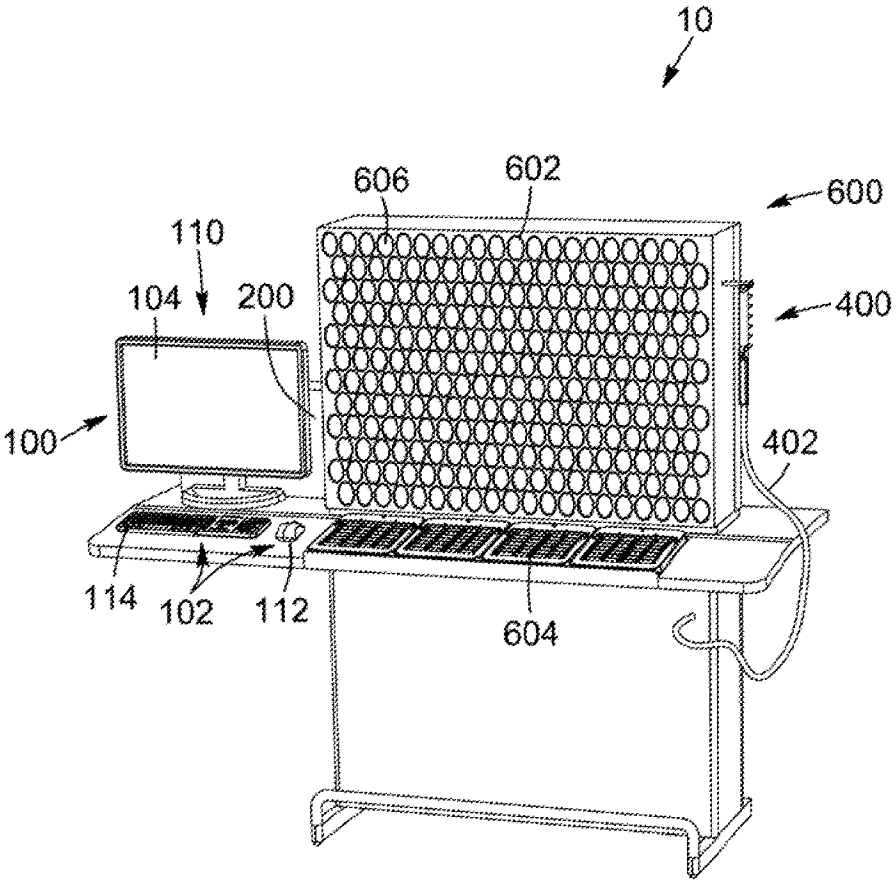
FIG. 1 is a front perspective view of a pill manipulating system for filling a packaging having a plurality of cavities, according to a possible embodiment.

As best shown in FIG. 1, a computerized control system 100 can individually control, open or close specific hose lines of the pill manipulating system 10. In other implementations, the computerized control system 100 can also illuminate target locations where the manipulated objects are to be retrieved and/or placed in their eventual final packaging, such as specific cavities 606 or drawers 608 of the pill rack 602 or specific cells or cavities 22 of the blister packaging 20, for example.

Figure 5:
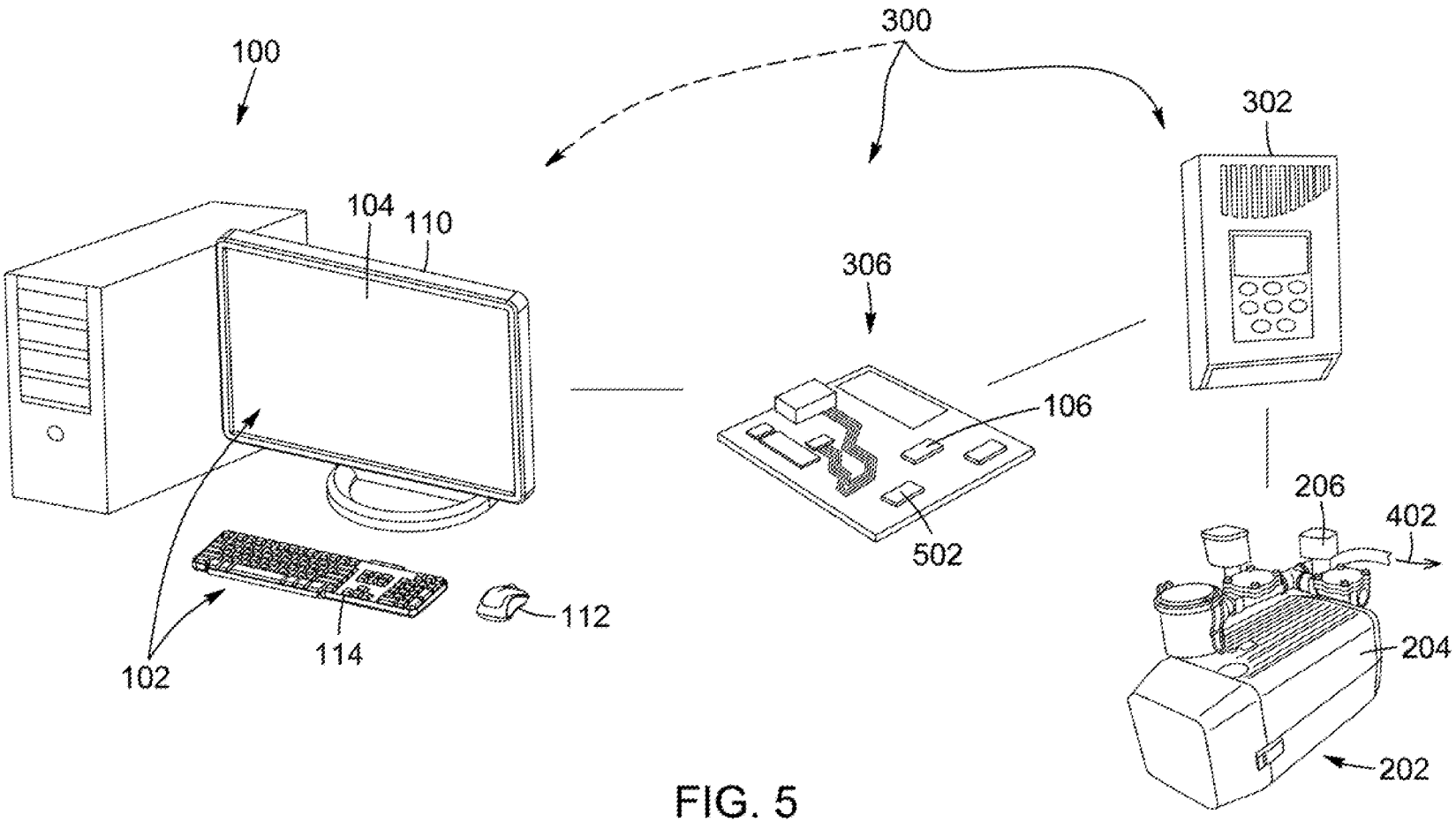
FIG. 5 is a schematic illustration of some of the components of the pill manipulating system of FIG. 1.
Figure 6:
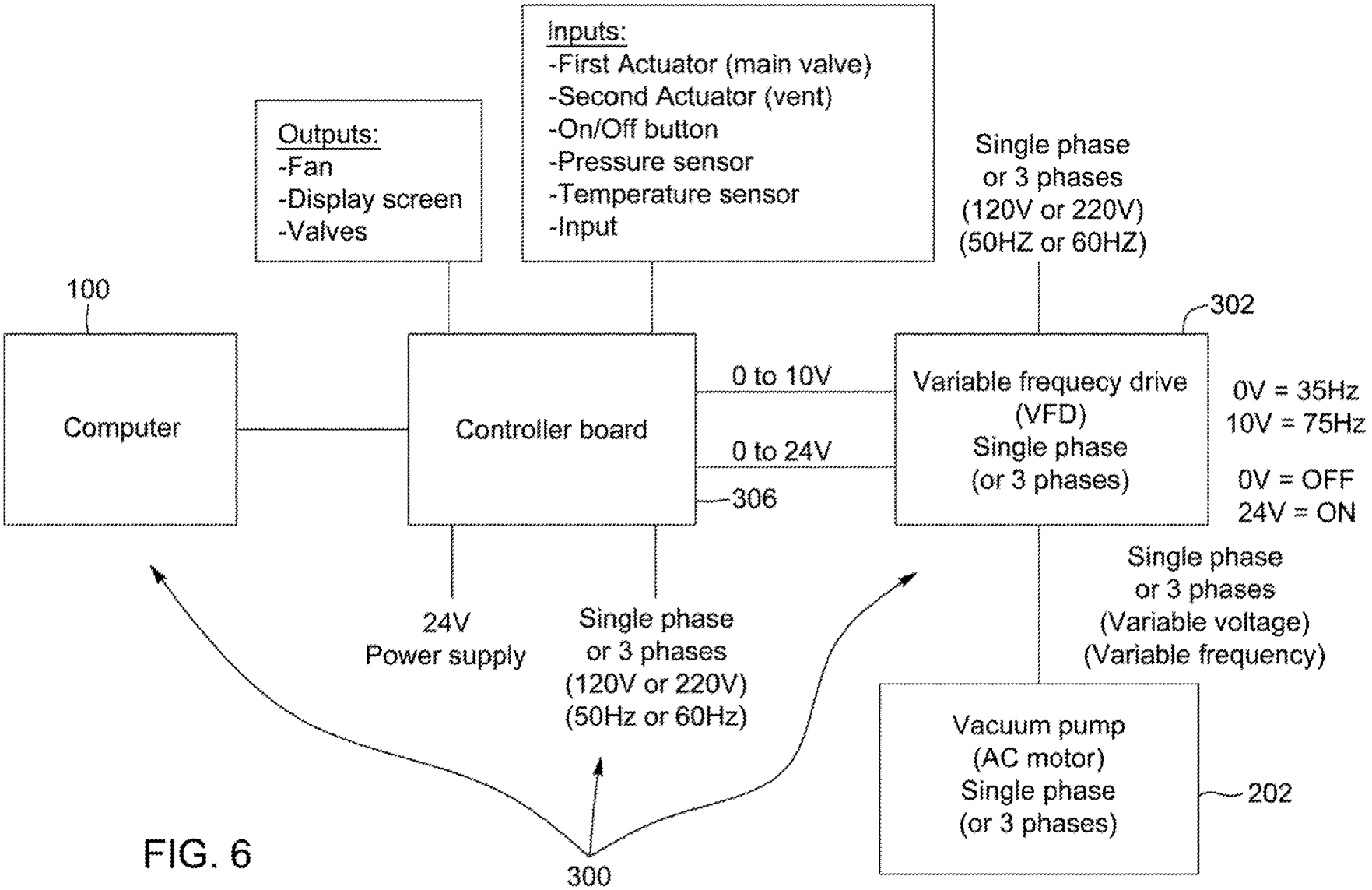
FIG. 6 is a schematic diagram of some of the components of a pill manipulating system of the invention, according to a possible embodiment.

Referring now to FIGS. 5 and 6, the vacuum pump controlling assembly 300 is shown. In this embodiment, an input 102 is provided allowing a user to input or select the type of pill to be inserted in the packaging 20. The input 102 can include one or more components, such as those illustrated in FIG. 5, i.e. a mouse 112, a keyboard 114 and/or a tactile screen. A software application or module provides a graphical user interface (GUI) 104 from which the user can select the type of pill to dispense in the packaging 20. The pill type can be selected by specifying a drug code, such as a National Drug Code (NDC) as used in the United States, or a Drug Identification Number (DIN) as used in Canada. In other embodiments, the pill type can be selected by scanning a bar code associated with a drug identifier. According to a further possible embodiment, the pill type can be automatically selected by a software application or module, adapted and configured to read or scan a prescription of a given patient, or to receive the pill type selection from another software application. Based on the pill type selected, the rotational speed of the vacuum pump is adjusted or set to a predetermined RPM that provides the proper air flow at the pump for the pill type selected. Smaller pills typically require less air flow (or suction) than larger pills, otherwise the prongs tend to suck up more than one smaller pill at a time. In yet other embodiments, it can be considered that the input 102 be a multi-level switch, and that according to the different positions of the switch, the RPM of the vacuum pump is adjusted. A user can thus place the switch is the proper position according to the pill type they are manipulating.

The association of the proper air flow of the vacuum pump with the pill type selected is stored in an non-transitory memory 106, such as in one of: the memory of the computer 100, the memory of the controller board 306 or the memory of remote servers, which may be distributed or not. This association of the vacuum level and/or air flow rate and pill type can be made by the end user (such as a pharmacist or lab technician), using the input, after having determined the proper level of suction that allows suctioning one pill per prong and no more, in most instances. The "suction level" can be translated into the air flow at the pump, or flow rate (measured in $ft^3/m$, l/s, l/min or cfm—cubic feet per minute); the pumping speed or rotational speed of the motor (in rpm); the frequency or voltage used to drive the motor (in Hz or V) or any other similar measuring unit characterizing the operation of the vacuum pump and/or of its motor. The air flow or flow rate is the volume of air drag by the vacuum pump per unit of time. Preferably, the pill manipulating system of the present invention allows storing the appropriate flow rates (or equivalent, such as rpms for example) for a plurality of pill types, such as at least more than ten different pill types, and in some implementations over a hundred different pill types.

The determination of the required RPM for a given pill type can be made by an automated calibration process that varies the rotational speed of the pump from a maximum speed (RPM) to lower speeds and that continuously monitors the pressure during the calibration process. For example, the automated calibration can gradually decrease the frequency supplied at the pump by a predetermined interval, such as 10 Hz, and the vent can be opened automatically by the controller board or by the computer, at each speed stage, before monitoring the pressure result until at least one of the prongs does not have a pill at the tip, creating a noticeable vacuum pressure leak. This calibration process allows determining the minimum motor speed for holding a single pill at each prong even after having activating the vent. Then, the RPM associated with a specific pill type can be set to said minimum speed plus a preset buffer, such as 20% for example. Once determined. the RPM determined by the calibration process for a given pill type is registered in memory, either at the controller board 306, in the computer's memory 106 or stored remotely.

Figure 7:
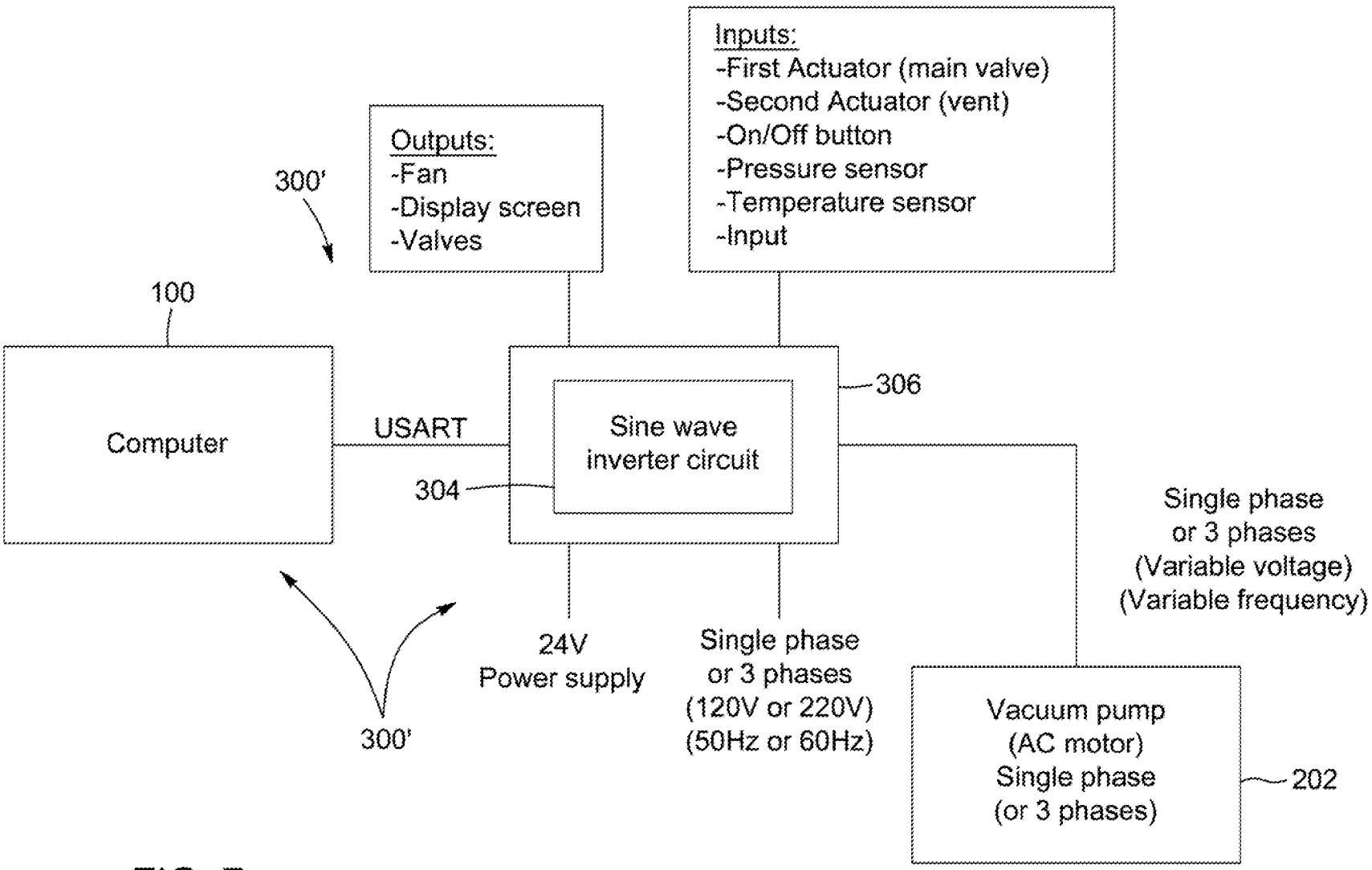
FIG. 7 is a schematic diagram of some of the components of the pill manipulating system of the invention, according to another possible embodiment.

Referring now to FIGS. 6 and 7, two different embodiments of a vacuum pump controlling assembly 300 are shown. In FIG. 6, the controlling assembly 300 includes a controller board 306 and a variable frequency drive 302. The controller board 306 can be operatively connected to the computer 100 with a communication link, such as a USART (Universal Synchronous/Asynchronous Receiver/Transmitter) for example. Of course, other types of communication links and protocols can be used, such as Bluetooth for example. While the vacuum pump controlling assembly 300 preferably includes a computer 100, the computer 100 is optional. The computer 100 can provide the input and an interface to turn on and off the vacuum pump, control the different valves, monitor the pressure inside the hose 402 and/or temperature of the vacuum pump 202.

Referring to FIG. 6, the controller board 306 can be powered by a DC line (such as 24V) and receives a single or three phase electrical signal (120V or 220V, 50 or 60 Hz), for embodiment in which an AC motor is used. The controller board can include a protection mechanism, to cut the power to the pump in case of overheating. For example, the voltage line passes through a fuse, such as a 10 A fuse, to provide overcurrent protection. The voltage line then passes through a thermal cutoff, such as a thermal fuse that melts at a predetermined temperature, such as 80° C., before entering the VFD 302. The protection mechanism protects the vacuum pump should the microcontroller fail in stopping it when a preset temperature threshold is exceeded. The variable frequency drive (VFD) 302 can be a single phase or three phase drive. The VFD 302 receives the single phase or three phase electrical signal (120V or 220V, 50 Hz or 60 Hz) from the controller board 306. The VFD 302 is in turn connected to the vacuum pump, preferably including an AC motor, which can be a single phase or three phase AC motor. The VFD can modulate or adjust the maximum air flow of the vacuum pump based on instructions received from the controller board 306, and/or from the computer 100, based on an input selected. In possible embodiments, the controller board sends output signals to at least one of a fan, a display screen to display the state of the pump, the main valve 208, and the vent, and of an on/off actuator for the vacuum pump. The controller board 306 can also receive input signals from the first and second actuators 420, 422 of the pill manipulator 400, and also possibly from the temperature and/or pressure sensors 502, 504. The vacuum pump controlling assembly 300 can thus further adjust the vacuum pump air flow based on readings from said at least one sensor, as explained in more details below. Of course, in alternate embodiments, some of the functions of the controller board 306 can be integrated in the software application executable by the computer's processor.

Referring now to FIG. 7, another possible embodiment of a vacuum pump controlling assembly 300 is shown. This embodiment is similar to the one shown in FIG. 6, with the difference that the functions of the variable frequency drive are integrated in the controller board 306, and thus the controller board 306 communicates with the vacuum pump directly. The controller board 306 can include a microcontroller programed with a sine wave inverter circuit, to control the vacuum pump directly, based on the type of pill selected at the input. The microcontroller can thus generate the variable motor input frequency and voltage. As can be appreciated, with either embodiments, the vacuum pump controlling assembly can set the maximum air flow or rotational speed of the vacuum pump to a first value for a first pill type selected, and can set the maximum air flow or rotational speed of the vacuum pump to a second value lower than the first value for a second pill type which is smaller than the first pill type. For example, if the pill type selected at the input corresponds to small-size pills, the computer 100 sends a signal to adjust the rotational speed of the motor of the vacuum pump. Preferably, the signal from the computer is sent to the controller board 306, which reduces the motor input frequency to about 40 Hz, directly through a sine wave inverter circuit 304 or via a VFD 302. If the pill type selected corresponds to mid-size pills, the motor input frequency is raised to about 50 Hz, and similarly, if the pill type selected corresponds to large-size pills, the motor input frequency is raised to about 60 Hz. Since the proper suction level for different pill types is stored in memory, adjusting the vacuum pump does not need to be done each time. Advantageously, using electronic circuits to control the AC motor speed, such as included in a VFD, allows raising the maximum air flow of the pump by increasing the variable input frequency above the standard 60 Hz provided by the utility services.

Figure 9:
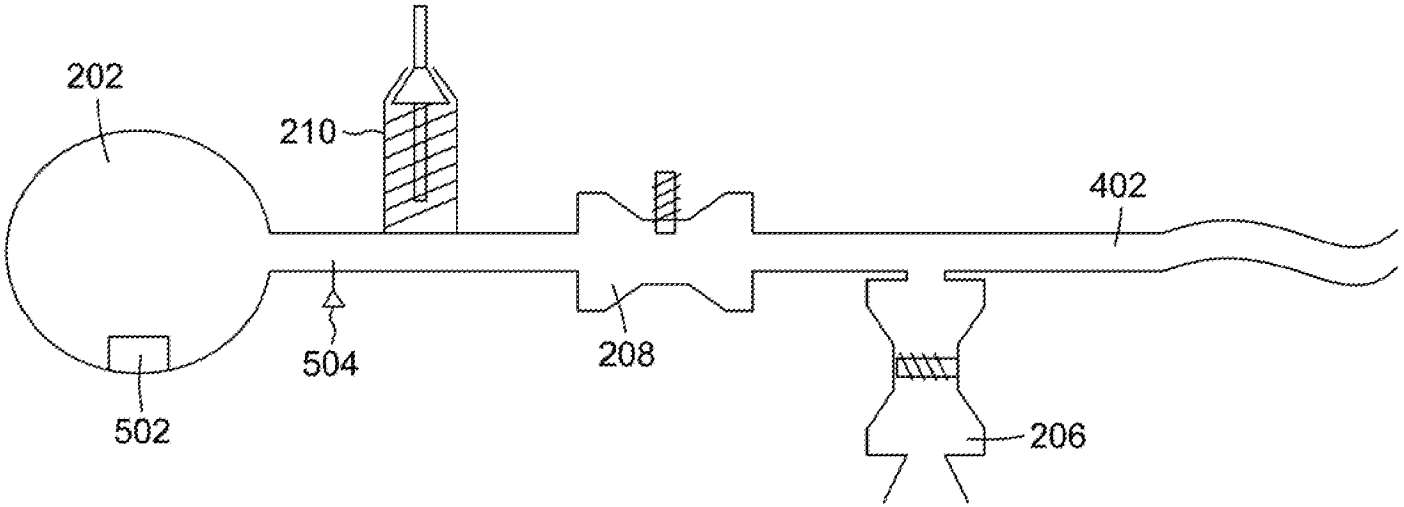
FIG. 9 is a schematic diagram of some of the elements of a pill manipulating system, according to possible configuration.

Referring to FIGS. 6, 7 and 9, a temperature sensor 502 can be placed near or in the vacuum pump 202 to control the operation of a fan, according to the temperature of the pump, measured by the sensor 502. Based on the measured temperature, the speed of the fan can be increased, decreased or stopped. Measured temperatures are sent from the sensor 502 to the controller board 306, which in turn is operatively connected to the fan. When a measured temperature reaches a predetermined temperature threshold, the vacuum pump can be stopped to prevent the pump from overheating. Monitoring the vacuum pump temperature also allows adjusting the speed of the vacuum pump 202 in function of the measured temperature. In addition, when the vacuum pump temperature is low, the vacuum pump 202 draws more current and thus the controller board 306 can instruct the motor 204, via the drive 302, not to exceed a predetermined speed as long as a minimal threshold temperature has not been reached, such as 45 degrees Celsius for example. The controller board 306 can also control the speed of the fan based on the measured temperature, for example to stop the fan during warming of the vacuum pump 202.

Still referring to FIGS. 6, 7 and 9, a pressure sensor 504 can be placed in the hose, near the extremity connected to the vacuum pump, to monitor the pressure within the hose. The pressure measured can be used to detect leaks, and to troubleshoot operations of the valves, of the pill manipulator 400 and of the vacuum pump. The monitoring/troubleshooting of the system can be performed remotely, by having the controller board 306 communicate the sensor data to the computer 100, and by accessing the computer 100 using a remote access.

Referring now to FIGS. 1 to 8, according to another aspect of the invention, a method for filling a packaging 20 is provided. The method includes the steps of adjusting a supply of suction to at least one prong of the pill manipulator based on a pill type; retaining at least one pill with the at least one prong via suction; placing the at least one prong and the retained at least one pill over a corresponding cavity of the packaging; releasing the at least one pill into the corresponding cavity, thereby filling the packaging. Preferably, the method also comprises a step of selecting the pill type, which can be performed via an input, such as a switch to select a suction level, or via a graphical user interface, through which a user can enter a drug code or drug identifier, such as a National Drug Code (NDC) used in the United States, or a Drug Identification Number (DIN). Instructions to adjust the supply of suction are made in according to the type of pill selected and can include varying the rotational speed of the motor of the vacuum pump, thereby adjusting the suction level at the tip of the prong(s). The steps of suctioning the pills with the prongs, placing the prongs over the cavities of the package and releasing the pills can be made manually, such as by using a manually operable pill manipulator, or can be automated by using a robotised pill manipulator. With regard to the step of releasing the pills into the containers, according to a possible option, dropping the pills can be achieved by closing a main valve of the vacuum pump, and by opening a vent slightly thereafter, as described previously.

As can be appreciated, the pill manipulating system disclosed herein allows for adjusting the air flow at the vacuum pump in function of, or based on, the type of pill to be stored in the packaging. This adjustment helps avoiding suctioning more than one pill at the time by the prong(s), especially for smaller pills. In addition, according to possible embodiments, the pill manipulating system of the invention allows controlling and monitoring the vacuum pump via the computer, using a graphical user interface.

Of course, numerous modifications could be made to the above-described embodiments without departing from the scope of the invention, as defined in the appended claims.

The invention claimed is:

1. A pill manipulating system for filling a packaging having a plurality of cavities with pills, the system comprising:

a vacuum pump;

a pill manipulator including:

a hose in fluid engagement with the vacuum pump; and at least one prong in fluid engagement with the hose, the at least one prong having an opening at one end sized to retain a pill when the pill manipulator is in a retain configuration and suction is applied, and to release the pill in a corresponding cavity of the packaging when the pill manipulator is in a release configuration and suction is reduced; and a vacuum pump controlling assembly including a variable frequency drive, for adjusting an air flow of the vacuum pump based on a selected input, which is representative of a size of the pills being manipulated, thereby reducing the likelihood of having the at least one prong retaining more than one pill at a time.

2. A pill manipulating system according to claim 1, wherein the input is a graphical user interface for selecting a pill type to be manipulated.

3. A pill manipulating system according to claim 1, wherein the input is for selecting a national drug code (NDC) or a drug identification number (DIN).

4. The pill manipulating system according to claim 1, wherein the vacuum pump comprises a motor, and wherein the controlling assembly varies the rotational speed of the motor based on the input selected.

5. The pill manipulating system according to claim 1, wherein the vacuum pump controlling assembly varies at least one of current, voltage and frequency supplied to the vacuum pump based on the input selected.

6. The pill manipulating system according claim 1, wherein the variable frequency drive is a single or a three-phase variable frequency drive.

7. The pill manipulating system according to claim 1, wherein the pill manipulator comprises a first actuator operatively connected to the vacuum pump, for actuating a main valve of the vacuum pump and placing the manipulator in the release configuration.

8. The pill manipulating system according to claim 7, further comprising a second actuator actuating a valve in fluid communication with a vent provided along a suction flow path extending from the vacuum pump to the at least one prong, the second actuator opening the vent and therefor reducing suction in the at least one prong upon being activated, the second actuator allowing to release extra pill(s) suctioned at the end of the at least one prong when the manipulator is in the retain configuration.

9. The pill manipulating system according to claim 7, comprising a pressure relief valve disposed between the vacuum pump and the main valve.

10. The pill manipulating system according to claim 1, comprising a proportional valve provided along a suction flow path extending from the vacuum pump to the at least one prong, the proportional valve having an adjustable 0%-100% opening.

11. The pill manipulating system according to claim 1, comprising a computer providing the input, and wherein the vacuum pump controller assembly comprises a controller board operatively connected to the computer and to the vacuum pump, the controller board translating instructions received from the computer with regard to the pill size or pill type into instructions for the variable frequency drive to control the rotational speed (rpm) of the motor.

12. The pill manipulating system according to claim 1, further comprising at least one of a pressure and a temperature sensor, the vacuum pump controlling assembly controlling operation of the vacuum pump based on readings from said at least one sensor.

13. The pill manipulating system according to claim 1, wherein the pill manipulator comprises a handle extending from the hose, and a manifold provided between the handle and the at least one prong, the pill manipulator being manually operable.

14. The pill manipulating system according to claim 1, wherein the vacuum pump controlling assembly sets a rotational speed of the vacuum pump to a first value for a first selected pill type, and wherein the vacuum pump controlling assembly sets the rotational speed of the vacuum pump to a second value lower than the first value for a second pill type that is smaller than the first pill type.

15. The pill manipulating system according to claim 1, comprising a non-transitory memory for storing rotational speeds of the vacuum pump associated with predetermined pill types.

16. The pill manipulating system according to claim 1, wherein the input for selecting the pill type comprises a software module adapted to read patient prescriptions and determine the pill type from information provided in the patient prescriptions.

* * * * *